US006520075B1

(12) United States Patent
Shinoda et al.

(10) Patent No.: US 6,520,075 B1
(45) Date of Patent: Feb. 18, 2003

(54) DOUBLE ACTION HYDRAULIC PRESS

(75) Inventors: Tomoaki Shinoda, Sagamihara (JP); Hiroshi Hosoya, Hachioji (JP); Hisashi Morimoto, Ishikawa-Ken (JP)

(73) Assignee: Aida Engineering Co., Ltd., Kanagawa (JP)

( * ) Notice: Subject to any disclaimer, the term of this patent is extended or adjusted under 35 U.S.C. 154(b) by 117 days.

(21) Appl. No.: 09/663,771

(22) Filed: Sep. 18, 2000

(30) Foreign Application Priority Data

Oct. 1, 1999 (JP) ..... 11-281222

(51) Int. Cl.[7] ..... B30B 1/42

(52) U.S. Cl. ..... 100/214; 100/273; 100/264; 100/257; 100/269.14; 100/269.13; 100/269.6; 72/453.02; 72/350; 72/351; 72/417; 425/193; 425/451

(58) Field of Search ..... 100/257, 273, 100/269.14, 214, 269.13, 269.6, 269.7, 264; 72/453.02, 417, 350, 351; 425/193, 192 R, 451, 451.9, 450.1, 444, 567, 182

(56) References Cited

U.S. PATENT DOCUMENTS 3,902,347 A * 9/1975 Ridgway et al. ..... 100/214
4,375,781 A * 3/1983 Bessho ..... 100/269.09
4,457,684 A 7/1984 Gram ..... 425/451.9
4,766,758 A * 8/1988 Lucas et al. ..... 100/99
5,375,513 A * 12/1994 Michael et al. ..... 100/207
5,528,918 A * 6/1996 Kirii ..... 72/15.1
6,128,987 A * 10/2000 Nakagawa et al. .... 100/269.14

FOREIGN PATENT DOCUMENTS

DE 4441442 A 5/1996
EP 0 596 696 A1 5/1994 ..... B21D/24/14

OTHER PUBLICATIONS

Patent Abstracts of Japan, Pub. No. 10–263888, Oct. 6, 1998.
Search Report for European Patent Application No. 00308661.8 published Jan. 2, 2002.

* cited by examiner

*Primary Examiner*—Allen Ostrager
*Assistant Examiner*—Jimmy Nguyen
(74) *Attorney, Agent, or Firm*—Darby & Darby

(57) ABSTRACT

A high precision, all-purpose, double action hydraulic press, which can control the speed, position, and parallelism of each slide, can conduct mold exchanges easily, and prevent the breakthrough phenomenon is provided with an outer slide 4, an inner slide 6, drive cylinders 8 and 9 which drive each of the slides, position detection devices 14 and 15 which detect the position of each of the slides, push pins 13, a damper cylinder 10 which prevents breakthrough phenomenon, and a die plate 5 which is equipped with push pins 13. By controlling the flow in the hydraulic pressure circuit which is connected to each of the drive cylinders, the speed, position, and parallelism of each of the slides are controlled.

2 Claims, 3 Drawing Sheets

DOUBLE ACTION HYDRAULIC PRESS

BACKGROUND OF THE INVENTION

The present invention relates to a double action hydraulic press used for molds that can conduct several types of plastic workings on a plurality of locations of a single material.

As an example of the prior art technology, there is a double action hydraulic press disclosed in Japanese Laid Open Patent Number H10-263888.

In the double action hydraulic press of the prior art, a plurality of inner slide drive cylinders are provided inside an outer slide. In addition, by controlling the flow of oil supplied to each of the inner slide drive cylinders based on some position detection values of the inner slide, the speed, position, and parallelism of the inner slide can be controlled. The outer slide conducts a first molding, and the inner slide conducts a second molding via a push pin, which is a means for transferring pressure.

However, with the double action hydraulic press of the prior art, when controlling the speed, position, and parallelism of the inner slide, the flow of oil supplied to each of the inner slide drive cylinders is controlled separately. As a result, the rod positions among the inner slide drive cylinders can be easily shifted, and as a result, the control of the inner slide becomes difficult. Furthermore, there is a plurality of inner slide drive cylinders provided inside the outer slide. As a result, the space inside the outer slide must be large, and miniaturization of machines becomes difficult.

Furthermore, with the double action hydraulic press of the prior art, there is no measure to combat against the so-called breakthrough phenomenon where the outer slide or the inner slide descends below the bottom dead center during punching.

Therefore, when punching is conducted with the double action hydraulic press of the prior art, noise and vibrations due to breakthrough phenomenon is generated, and as a result, there are negative effects on the product precision and on the environment.

Furthermore, the push pins are supported in a freely rising and falling manner by a sliding member provided on the lower surface of the outer slide, but the lower surface plate of the outer slide can not be removed. As a result, the operation for exchanging the push pins, which occurs in conjunction with the changing of the mold, becomes extremely complicated.

OBJECTS AND SUMMARY OF THE INVENTION

An object of the invention is to provide a double action hydraulic press, in which the changing operation for the push pins, which occurs in conjunction with mold changes, is easy.

A further object of the invention is to provide a double action hydraulic press, wherein costs are reduced due to miniaturization of construction members. In addition, the speed, position, and parallelism of the inner slide can be controlled easily with high precision.

A further object of the present invention is to provide a double action hydraulic press, in which breakthrough phenomenon during punch working is reduced.

The invention in one embodiment is a double action hydraulic press, the double action hydraulic press having a separate drive source for each slide, and comprising: an outer slide, which is guided in a freely rising and falling manner by an outer slide guide provided on a column; an inner slide, which is guided in a freely rising and falling manner by an inner slide guide provided inside the outer slide; an outer slide drive cylinder, which is provided on a press crown part, has an end of a rod connected to the outer slide, and drives the outer slide; an inner slide drive cylinder, which is provided in the outer slide, has an end of a rod connected to the inner slide, and drives the inner slide; a die plate, which is provided in a detachable manner on a lower surface of the outer slide; a push pin, which is supported in a freely rising and falling manner by a sliding member provided on the die plate and is provided with a spring between a collar part and a die plate upper surface.

With this embodiment, the outer slide and the inner slide, which is provided inside the outer slide, each have a separate drive source. As a result, several types of plastic working can be conducted on a single material. Furthermore, the die plate, which is provided on the outer slide lower surface and is provided with push pins, is detachable. Therefore, when exchanging the push pins in conjunction with an exchange in molds, the die plate, which is provided with the push pins, is exchanged. Furthermore, by altering the shape of the die plate according to the mold, it can correspond to various dies.

The above described embodiment additionally, can comprise: a plurality of the outer slide drive cylinders and the inner slide drive cylinders; a plurality of outer slide position detection devices, which detect the positions of the outer slides; an outer slide control device, which, by controlling the flow volume supplied to the outer slide drive cylinder based on the detection values detected from the outer slide position detection devices and a pre-set value, controls the outer slide so that its speed, position, and parallelism are maintained; a plurality of inner slide detection devices, which detect the positions of the inner slides; an inner slide control device, which, by controlling the flow volume supplied to the inner slide drive cylinder based on the detection values detected from the inner slide position detection devices and a pre-set value, controls the inner slide so that its speed, position, and parallelism are maintained.

With the above double action hydraulic press, a plurality of outer slide drive cylinders is provided, and based on the values detected by the outer slide position detection devices and a pre-set value, the flow of oil supplied to each of the cylinders can be controlled. As a result, the speed, position, and parallelism of the outer slide can be controlled. Furthermore, a plurality of inner slide drive cylinders is provided inside the outer slide, and by controlling the flow of oil supplied to each of the cylinders, the speed and position of the inner slide can be controlled, and the parallelism can be maintained.

The double action hydraulic press can include in addition: an equalize shaft, which passes through the outer slide and the inner slide, is provided at both ends with a pinion, and is supported by a bearing provided on the inner slide; a rack, which is provided on the outer slide and engages with the pinion.

In the invention, the equalize shaft is passed through the outer slide and inner slide and is supported by a bearing provided on the inner slide. A pinion is provided on both ends of this equalize shaft, and a rack, which engages with said pinion, is provided on the outer slide. For example, when the equalize shaft passes through in the front to back direction, the speed and the position of the inner slide in the front to back direction is synchronized, and as a result, the parallelism of the inner slide in the front to back direction can be maintained.

Furthermore, because the parallelism of the inner slide can be maintained by mechanical construction members, the number of inner slide drive cylinders can be reduced.

For example, the parallelism in the left to right direction is controlled by the inner slide drive cylinder, and the parallelism in the front-back direction is maintained by a mechanical construction member of an equalize shaft. In this situation, the number of inner slide drive cylinders which are necessary is two. As a result, compared to when three or greater inner slide drive cylinders are necessary, the control is greatly improved because there are fewer things that need to be controlled. In addition, when the number of inner slide drive cylinders is reduced, the outer slide can be miniaturized, and this can result in miniaturization of the overall machine.

The double action hydraulic press can comprise in addition: a damper cylinder, which is provided on the bottom of the inner slide and is provided with a flow metering valve on a hydraulic circuit which is connected with the cylinder.

With this, there is provided a damper cylinder which descends while in contact with the inner slide lower surface. When this occurs, because the oil volume which flows out of the cylinder is restricted by a flow metering valve in a hydraulic circuit, there is high pressure inside the cylinder. As a result, even when punching with the inner slide and breakthrough phenomenon occurs, the rapid descent of the inner slide can be reduced. As a result, the work environment and product precision can be improved.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Embodiments of the present invention will are described below.

Figure 1:
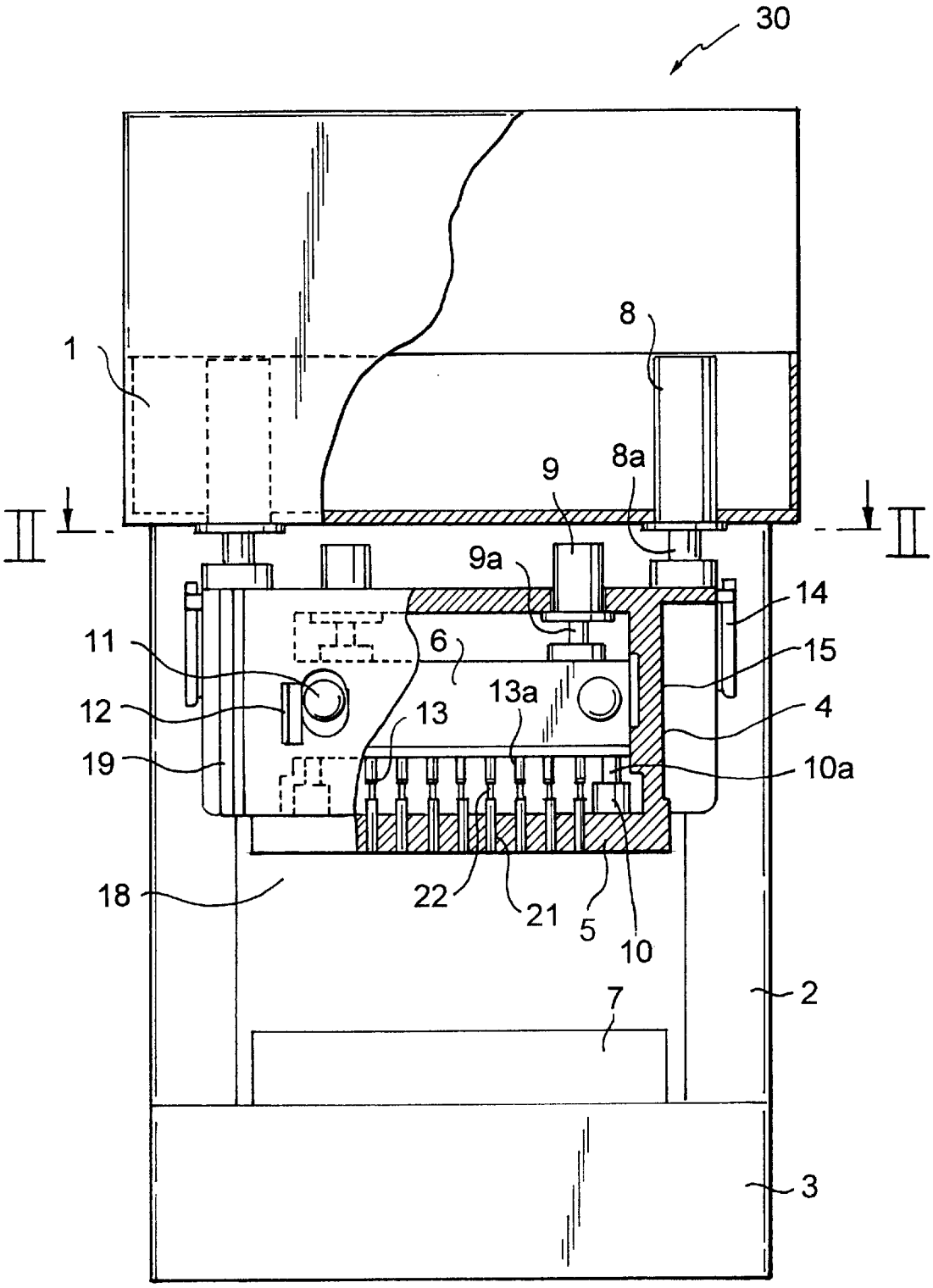
FIG. 1 is a front view of a double action hydraulic press machine of the present invention with portions thereof broken away and some parts shown in section.
Figure 2:
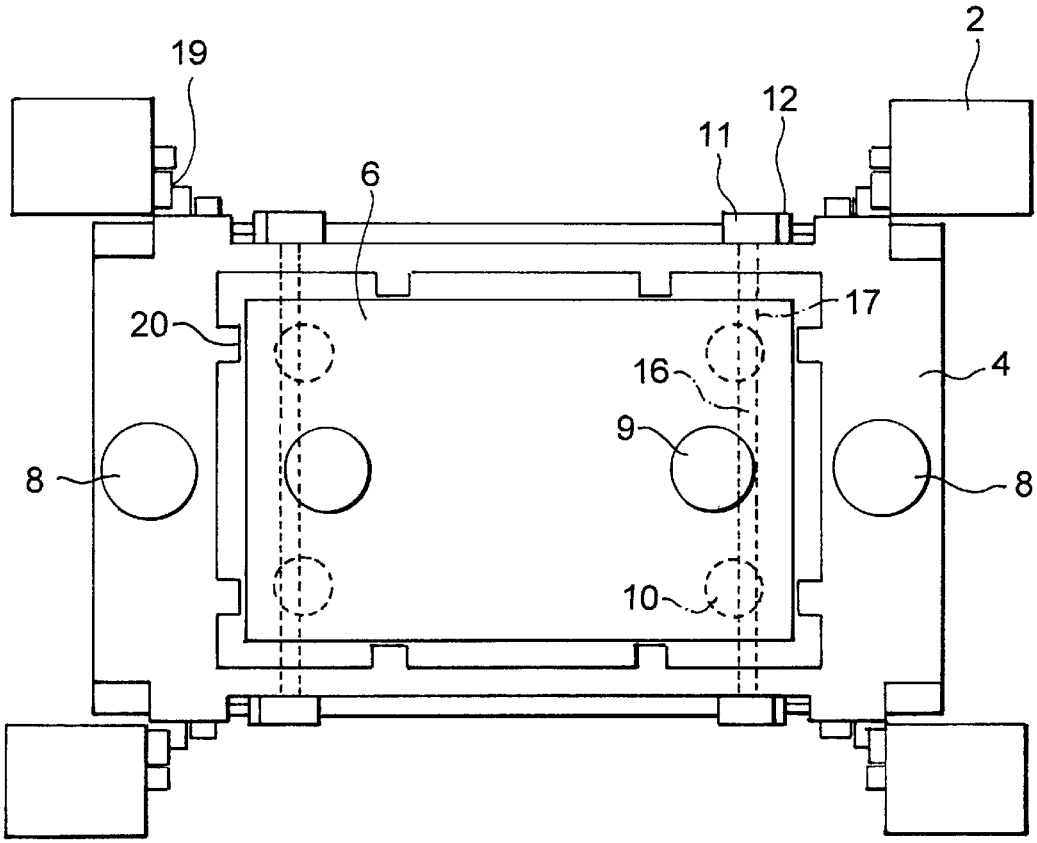
FIG. 2 is a cross-section taken along the line II—II in FIG. 1.

Referring to FIGS. 1 and 2, a double action press machine 30 has a frame construction, comprising a crown 1, a column 2, and a bed 3. A bolster 7 is provided on top of bed 3. A double action slide 18 is provided opposite bolster 7. Double action slide 18 is equipped with an outer slide 4 and an inner slide 6.

Outer slide 4 is supported in a freely rising and falling manner by an outer slide guide 19, which is provided on column 2. An outer slide drive cylinder 8 is provided on crown 1. A rod 8*a* of outer slide drive cylinder 8 is connected to outer slide 4.

An inner slide 6, which is supported in a freely rising and falling manner by an inner slide guide 20, is provided in the interior of outer slide 4. A rod 9*a* of inner slide drive cylinder 9, which is provided on the interior of outer slide 4, is connected to inner slide 6.

Furthermore, two outer slide position detection devices 14, which detect the position and the tilt of outer slide 4, is provided on column 2. Two inner slide position detection devices 15, which detect the position and the tilt of inner slide 6, is provided on the interior of outer slide 4. The measurements that are detected can either be a relative position or an absolute position.

A die plate 5 is provided in a detachable manner on the lower surface of outer slide 4. Push pins 13, which are supported in a freely rising and falling manner on a sliding member 21, are provided on die plate 5. Springs 22 are provided between collars 13*a* of push pins 13 and die plate 5. An upward force is applied to push pins 13 by the spring force. Therefore, the upper surface of push pin 13 is in contact with the lower surface of inner slide 6. As a result, when inner slide 6 descends, push pins 13 also descend. In this manner, push pins 13 transfer the pressure of inner slide 6.

Furthermore, die plate 5 can be removed with push pins 13 attached. In other words, when conducting mold exchange, if the positions or the number of push pins 13 are to be changed, by having a separate die plate 5, which has the push pins 13 arranged with the planned changes, prepared in advance, a more rapid mold exchange can be conducted.

Equalize shafts 16 are provided on the right and left in such a way that equalize shafts 16 pass through both outer slide 4 and inner slide 6 in the front to back direction. Equalize shaft 16 is supported by a bearing 17, which is provided on inner slide 6. A pinion 11 is provided on both ends of equalize shaft 16. Pinion 11 engages with a rack 12, which is provided on outer slide 4.

Figure 3:
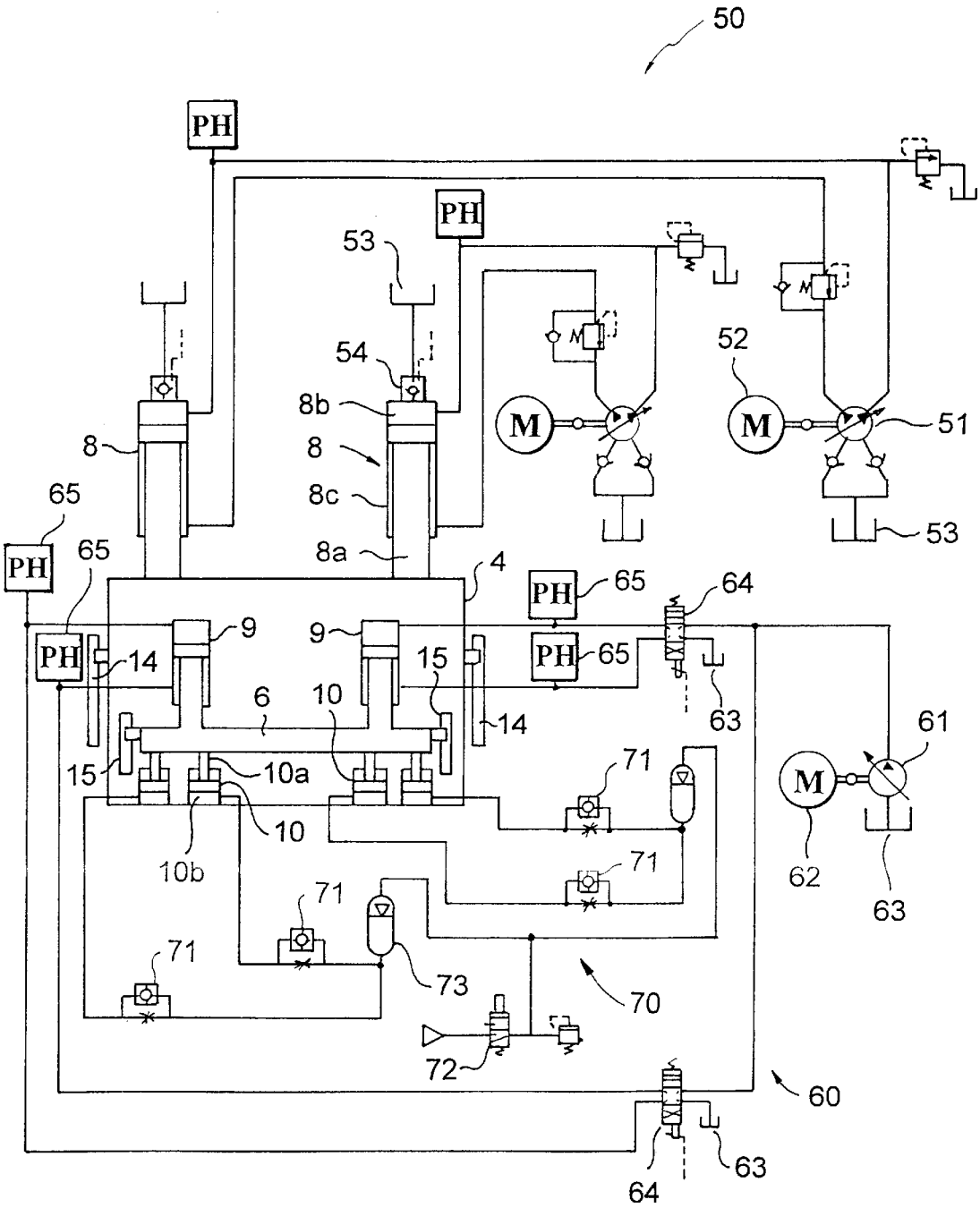
FIG. 3 is a hydraulic circuit diagram of the double action hydraulic press machine of the present invention.

Next, referring to FIG. 3, a hydraulic circuit diagram of the double action hydraulic press of the present embodiment is shown.

With regard to an outer slide drive circuit 50, a closed circuit is constructed between a variable volume hydraulic pump 51, which has a motor 52 as its power source and has a tank 53, and outer slide drive cylinder 8. A pilot check valve 54, which discharges oil or allows the inflow of oil when conducting rapid ascent or descent, is provided on an upper oil compartment 8*b* of outer slide drive cylinder 8. Furthermore, discharged oil is returned to tank 53.

With regard to inner slide drive circuit 60, a flow controlling valve 64 is provided between a variable volume hydraulic pump 61, which has a motor 62 as its power source and has a tank 63, and inner slide drive cylinder 9.

The motions of outer slide 4 and inner slide 6 will be described now.

When lowering outer slide 4, oil flows into upper oil compartment 8*b* due to variable volume hydraulic pump 51. When this occurs, the oil in lower oil compartment 8*c* flows into variable volume hydraulic pump 51. After being impelled by variable volume hydraulic pump 51, the oil again flows into upper oil compartment 8*b*.

Furthermore, the speed, position, and parallelism in the left to right direction are controlled by feedback. In other words, based on values detected from outer slide detection devices 14 and using the target values for speed, position, and left-right parallelism of outer slide 4 that have been determined in advance on an outer slide control device (not shown), the flow of variable volume hydraulic pump 51 is controlled. Because a variable volume hydraulic pump 51 is provided on each outer slide drive cylinder 8, outer slide drive cylinder 8 can be controlled individually. As a result, not only can the speed and position of outer slide 4 be controlled, but the left-right parallelism can also be controlled.

When raising outer slide 4, oil flows into lower oil compartment 8*c* due to variable volume hydraulic pump 51. When raising outer slide 4 rapidly, pilot check valve 54 is opened, and the discharged oil volume of upper oil compartment 8*b* is increased.

The up and down movement of inner slide 6 is conducted by switching the hydraulic pressure of variable volume hydraulic pump 61 by flow control valve 64. The speed, position, and parallelism of inner slide 6 are controlled by feedback. In other words, based on values detected by inner slide position detection devices 15 and using the target values for speed, position, and parallelism of inner slide 6 that have been determined in advance on an inner slide control device (not shown), flow control valve 64 is controlled. Furthermore, because a flow control valve 64 is provided on each inner slide drive cylinder, the left-right parallelism as well as speed and position of inner slide 6 can be controlled.

Furthermore, when raising and lowering inner slide 6, in addition to the rotating of pinion 11 which engages with rack 12, the equalize shaft also rotates. As a result, the front-back position and speed of inner slide 6 are synchronized. As a result, the front-back parallelism is maintained.

Furthermore, when inner slide 6 descends, push pins 13 are pushed out downwards. Thereupon, the lower ends of push pins 13 contact a punch within the mold (not shown), for example, and working of the material is conducted. In this manner, the pressure of inner slide 6 is transferred via push pins 13. When inner slide 6 is raised, push pins 13 are raised due to the reaction of springs 22.

Referring to FIG. 1, a damper cylinder 10 is provided on double action press machine 30. The end of a rod 10*a* of damper cylinder 10 is in contact with the lower surface of inner slide 6. Referring to FIG. 3, damper cylinder 10 is connected to a damper circuit 70. A flow metering valve 71, an oil tank 73, and a selector valve 72, which switches the use of damper cylinder 10, are provided on damper circuit 70.

When inner slide 6 is at the top dead center, oil is filled in a lower oil compartment 10*b* of damper cylinder 10. When inner slide 6 descends, rod 10*a* also descends. At this time, a constant pressure is maintained in lower oil compartment 10*b* by the flow metering valve. If inner slide 6 descends rapidly due to breakthrough phenomenon, rod 10*a* also tries to descends rapidly. However, because the discharge from lower oil compartment 10*b* is restricted by flow metering valve 71, there is a high pressure on lower oil compartment 10*b*. As a result, because rod 10*a* is supported with high pressure by lower oil compartment 10*b*, rapid descent of inner slide 6 is prevented, and the occurrence of the breakthrough phenomenon is suppressed.

In the present embodiment, linear scales are used for outer slide position detection devices 14 and inner slide position detection devices 15, however other sensors can also be used.

Furthermore, in the present embodiment, outer slide 4 is controlled by controlling the flow of variable volume hydraulic pump 51, but it can also be controlled by using a flow control valve as in inner slide drive circuit 60. In other words, if it is a hydraulic circuit which can control outer slide drive cylinder 8 by controlling flow, the construction does not matter. The same is true for inner slide drive circuit 60.

Furthermore, a mechanical construction member for maintaining parallelism, which is mainly constructed from equalize shaft 16, pinion 11, rack 12, extends in the forward-back direction, but if it is extended in the left-right direction, it has the effect of similarly maintaining parallelism in the left-right direction.

According to the double action hydraulic press of the invention, a mold, which can conduct several plastic workings on a single material, can be used. Furthermore, a die plate, which is provided on the lower surface of the outer slide and which is equipped with push pins, is detachable. Therefore, in conjunction with exchanging of the mold, when the positions and number of push pins are to be changed, a different die plate, which is equipped with push pins and which has been prepared in advance, can be exchanged. Furthermore, by changing the shape of the die plate in accordance with the mold, it can be used for a variety of molds. Further, by controlling the flow of oil supplied to each of the cylinders based on values detected from the outer slide position detection device and pre-set values, the speed, position, and parallelism in the left-right direction can be controlled. Furthermore, by controlling the flow of oil supplied to the inner slide drive cylinder, the speed and position of the inner slide can be controlled, and in addition the parallelism can also be controlled.

By having a mechanical construction member, which has as its main construction elements an equalize shaft, pinion, and rack, the parallelism of the inner slide can be maintained in the front to back direction.

According to the invention, by having a damper cylinder, breakthrough phenomenon can be suppressed. As a result, the work environment and product precision can be improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A double action hydraulic press, said double action hydraulic press having a plurality of slides and a separate drive source for each of said slides, comprising:

an outer slide, which is guided in a freely rising and falling manner by an outer slide guide provided on a column;

an inner slide, which is guided in a freely rising and falling manner by an inner slide guide provided inside said outer slide;

an outer slide fluid operated drive cylinder carried on a press crown part, said outer drive cylinder having an end of a rod connected to said outer slide for driving said outer slide;

an inner slide fluid operated drive cylinder carried on said outer slide, said inner slide drive cylinder having an end of a rod connected to said inner slide for driving said inner slide;

a die plate detachably mounted to a lower surface of said outer slide;

at least one push pin supported by a sliding member on said die plate for supporting said at least one push pin in a freely rising and falling manner on said die plate, and a spring disposed between a collar part on said inner slide and an upper surface of said die plate; and an equalize shaft passing through said outer slide and said inner slide, said equalize shaft carrying a pinion at each of two opposite ends of said equalize shaft, said equalize shaft being supported by a bearing carried on said inner slide;

each said pinion engaging racks carried on said outer slide.

2. A double action hydraulic press, said double action hydraulic press having a plurality of slides and a separate drive source for each of said slides, comprising:

an outer slide, which is guided in a freely rising and falling manner by an outer slide guide provided on a column;

an inner slide, which is guided in a freely rising and falling manner by an inner slide guide provided inside said outer slide;

an outer slide fluid operated drive cylinder carried on a press crown part, said outer drive cylinder having an end of a rod connected to said outer slide for driving said outer slide;

an inner slide fluid operated drive cylinder carried on said outer slide, said inner slide drive cylinder having an end of a rod connected to said inner slide for driving said inner slide;

a die plate detachably mounted to a lower surface of said outer slide;

at least one push pin supported by a sliding member on said die plate for supporting said at least one push pin in a freely rising and falling manner on said die plate, and a spring disposed between a collar part on said inner slide and an upper surface of said die plate; and a damper cylinder carried on a bottom of said inner slide, said damper cylinder being provided with a flow metering valve disposed in a hydraulic circuit connected with said damper cylinder.

* * * * *